US009080769B2

(12) United States Patent
Bronson et al.

(10) Patent No.: US 9,080,769 B2
(45) Date of Patent: Jul. 14, 2015

(54) APPARATUS FOR INDICATING LEVEL OF PILOT FLAME OUTPUT

(75) Inventors: John M. Bronson, St. Louis, MO (US); Damon R. Drumm, Imperial, MO (US); Ryan D. Jensen, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 943 days.

(21) Appl. No.: 13/207,593

(22) Filed: Aug. 11, 2011

(65) Prior Publication Data

US 2013/0040252 A1 Feb. 14, 2013

(51) Int. Cl.

| | |
|---|---|
| ***F23N 5/26*** | (2006.01) |
| ***F23N 5/10*** | (2006.01) |
| ***F23N 5/00*** | (2006.01) |
| ***F24H 1/20*** | (2006.01) |
| ***F24H 9/20*** | (2006.01) |
| ***F23N 5/24*** | (2006.01) |

(52) U.S. Cl.

CPC *F23N 5/10* (2013.01); *F23N 5/242* (2013.01); *F24H 1/205* (2013.01); *F24H 9/2035* (2013.01); *F23N 2023/08* (2013.01); *F23N 2031/02* (2013.01)

(58) Field of Classification Search

CPC ..... F23N 5/10
USPC ..... 431/13, 14, 42, 48, 60, 66, 69, 80; 340/577

See application file for complete search history.

(56) References Cited

U.S. PATENT DOCUMENTS

| | | | | |
|---|---|---|---|---|
| 4,483,673 | A * | 11/1984 | Murai et al. | 431/328 |
| 4,770,629 | A | 9/1988 | Bohan, Jr. | 431/59 |
| 4,854,723 | A * | 8/1989 | Her | 374/179 |
| 4,984,981 | A | 1/1991 | Pottebaum | 431/80 |
| 5,439,374 | A * | 8/1995 | Jamieson | 431/25 |
| 5,785,511 | A * | 7/1998 | Shah | 431/42 |
| 6,908,300 | B1 | 6/2005 | Donnelly | 431/22 |
| 6,920,377 | B2 | 7/2005 | Chian | 700/278 |
| 7,497,386 | B2 | 3/2009 | Donnelly et al. | 236/15 BG |
| 2006/0275720 | A1 | 12/2006 | Hotton et al. | 431/80 |
| 2007/0045276 | A1 * | 3/2007 | Fisher et al. | 219/268 |
| 2007/0099136 | A1 | 5/2007 | Cook | 431/77 |
| 2010/0043773 | A1 | 2/2010 | Aleardi et al. | 126/39 BA |

* cited by examiner

*Primary Examiner* — Avinash Savani
*Assistant Examiner* — Vivek Shirsat
(74) *Attorney, Agent, or Firm* — Harness, Dickey & Pierce, P.L.C.

(57) ABSTRACT

An apparatus is provided for a heating appliance that includes a manually-opened pilot valve that is held in an open position when a sufficient voltage is applied to a valve operator, and a thermocouple that converts heat from a pilot flame into a voltage that is applied to the valve operator. The apparatus includes a voltage measuring circuit that provides an output indicative of a magnitude of the voltage generated by the thermocouple, and a light emitting device. A controller is coupled to the voltage measuring circuit and the light emitting device. The controller is configured to establish, based on the output indicative of the magnitude of the voltage generated by the thermocouple, a switch sequence for switching the light emitting device on and off in a flashing manner, to provide an indication of when the magnitude of the voltage is sufficient to cause the valve operator to hold the gas valve open.

21 Claims, 9 Drawing Sheets

APPARATUS FOR INDICATING LEVEL OF PILOT FLAME OUTPUT

FIELD

The present disclosure generally relates to gas fired heating appliances such as water heaters, and more particularly to monitoring a pilot burner flame of such heating appliances.

BACKGROUND

This section provides background information related to the present disclosure which is not necessarily prior art.

Gas fired heating units such as gas water heater appliances typically comprise a gas valve for supplying gas to a main burner and a standing pilot burner within a burner chamber. Since water heaters now have sealed burner chambers, manual lighting of the standing pilot burner with a match is not possible. Accordingly, the gas valve has a manually-opened pilot valve that must be depressed and held open while an ignition device is activated to establish a pilot flame at the standing pilot burner. Once the pilot valve is manually opened and a pilot flame is established at the standing pilot burner, the pilot burner burns gas continuously to thereby provide an ignition source for the main burner. These gas valves and standing pilot burners operate independently of any connection to electrical power within the residential or commercial building. However, it is difficult for users to operate the pilot valve and ignition device and monitor the pilot burner flame.

SUMMARY

This section provides a general summary of the disclosure, and is not a comprehensive disclosure of its full scope or all of its features.

Various embodiments of an apparatus are provided for indicating the level of pilot flame output and when flame output is sufficient to cause a thermocouple to generate a voltage that will hold a pilot valve open. One embodiment of an apparatus includes a voltage measuring circuit having first and second connectors configured to be coupled to a thermocouple that generates a voltage in response to a gas pilot flame supplied by a gas valve. The voltage measuring circuit is configured to provide an output indicative of a magnitude of the voltage generated by the thermocouple. The apparatus includes a light emitting device and a controller coupled to the voltage measuring circuit and the light emitting device. The controller is configured to controllably switch the light emitting device on and off in a flashing manner at a frequency based on the output indicative of the magnitude of the voltage of the thermocouple, to thereby generate a flash rate corresponding to the magnitude of the voltage generated by the thermocouple. The flash rate increases as the magnitude of the voltage increases, to thereby provide an indication of when the voltage magnitude is sufficient to cause a valve operator to hold the gas valve open.

According to another aspect of the present disclosure, a system is provided for indicating the level of pilot flame output in a gas appliance having a manually opened gas valve. The system includes a gas valve having a manually-opened pilot valve that is held in an open position when a sufficient voltage is applied to a valve operator, and a thermocouple that converts heat from a gas pilot flame into a voltage that is applied to the valve operator. The system includes a voltage measuring circuit configured to provide an output indicative of a magnitude of the voltage generated by the thermocouple, and a light emitting device. A controller is coupled to the voltage measuring circuit and the light emitting device. The controller comprises a microprocessor that is configured to establish, based on the output indicative of the magnitude of the voltage generated by the thermocouple, a switch sequence for switching the light emitting device on and off in a flashing manner to thereby generate a flash rate corresponding to the magnitude of the voltage generated by the thermocouple. The flash rate increases as the voltage increases to provide an indication of when the magnitude of the voltage is sufficient to cause the valve operator to hold the gas valve open, where the manually-opened pilot valve must be held down until the voltage generated by the thermocouple is sufficient to hold the pilot valve open.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

According to one aspect of the present disclosure, various embodiments of an apparatus are provided for indicating when the level of pilot flame output is sufficient to cause a thermocouple to generate a voltage that will hold a pilot valve open. The apparatus includes a voltage measuring circuit having first and second connectors configured to be coupled to a thermocouple that generates a voltage in response to a gas pilot flame supplied by a gas valve. The voltage measuring circuit is configured to provide an output indicative of a magnitude of the voltage generated by the thermocouple. The apparatus includes a light emitting device and a controller coupled to the voltage measuring circuit and the light emitting device. The controller is configured to controllably switch the light emitting device on and off in a flashing manner at a frequency based on the output indicative of the magnitude of the voltage of the thermocouple, to thereby generate a flash rate corresponding to the magnitude of the voltage generated by the thermocouple. The flash rate increases as the magnitude of the voltage increases, to provide an indication of when the voltage magnitude is sufficient to cause a valve operator to hold the gas valve open.

According to another aspect of the present disclosure, a system is provided for indicating the level of pilot flame output in a gas appliance having a manually opened gas valve. The system includes a gas valve having a manually-opened pilot valve that is held in an open position when a sufficient voltage is applied to a valve operator, and a thermocouple that converts heat from a gas pilot flame into a voltage that is applied to the valve operator. The system includes a voltage measuring circuit configured to provide an output indicative of a magnitude of the voltage generated by the thermocouple, and a light emitting device. A controller is coupled to the voltage measuring circuit and the light emitting device. The controller comprises a microprocessor that is configured to establish, based on the output indicative of the magnitude of the voltage generated by the thermocouple, a switch sequence for switching the light emitting device on and off in a flashing manner to generate a flash rate corresponding to the magnitude of the voltage generated by the thermocouple. The flash rate increases as the voltage increases to provide an indication of when the magnitude is sufficient to cause the valve operator to hold the gas valve open, where the manually-opened pilot valve must be held down until the voltage generated by the thermocouple is sufficient to hold the pilot valve open.

Figure 1:
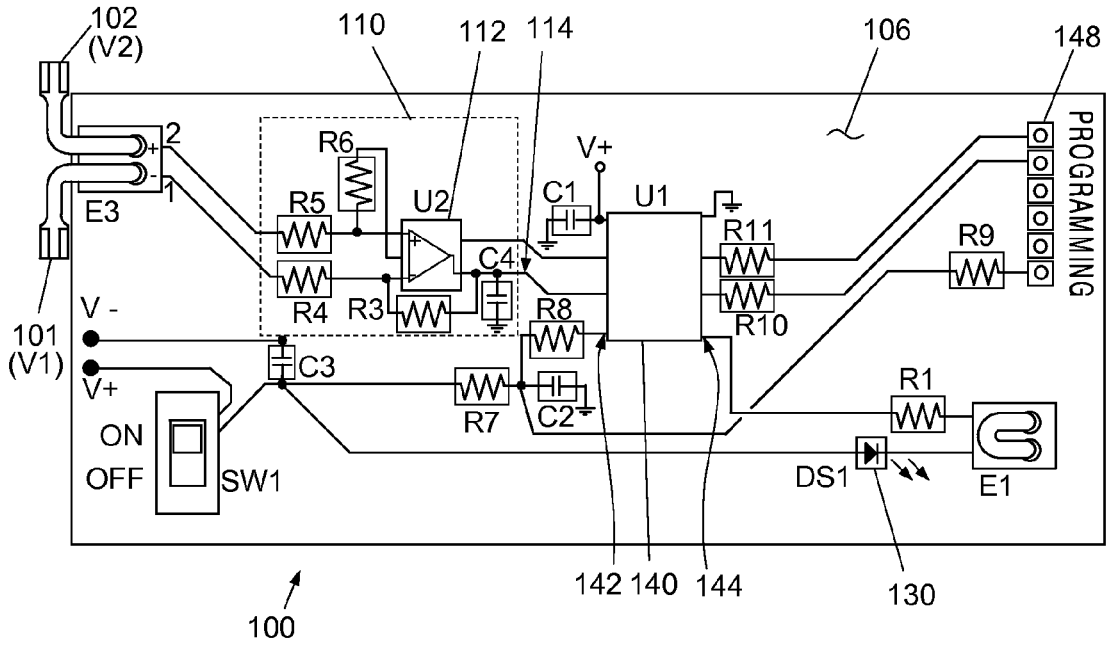
FIG. 1 is a top side view of one embodiment of an apparatus for indicating the level of pilot flame output, according to the present disclosure.
Figure 2:
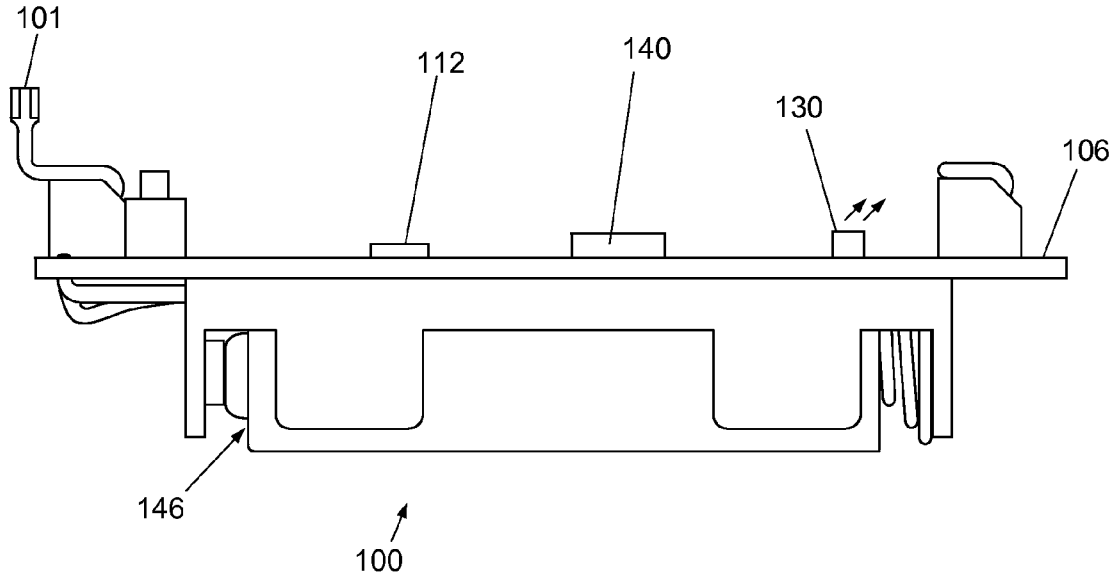
FIG. 2 is a side elevation view of the apparatus shown in FIG. 1.

Referring to FIGS. 1-2, a first embodiment of an apparatus is shown at 100. The apparatus 100 includes first and second connectors 101, 102 configured to be coupled to a thermocouple that generates a voltage from a pilot flame that receives gas from a gas valve (not shown). The apparatus 100 preferably comprises a circuit board 106, and includes a voltage measuring circuit 110 configured to provide an output indicative of a magnitude of the voltage generated by a thermocouple (see item 12 in FIG. 3). The apparatus 100 further includes a light emitting device 130 and a controller 140 coupled to the voltage measuring circuit 110 and the light emitting device 130. The controller 140 is configured to determine (from the output of the voltage measuring circuit 110) the magnitude of the voltage generated by the thermocouple, and to controllably switch the light emitting device 130 on and off in a flashing manner to generate a flash rate corresponding to the magnitude of the voltage generated by the thermocouple. The flash rate increases as the magnitude of the voltage increases, to provide an indication of when the voltage is at a sufficient level to cause a valve operator to hold the gas valve open, as explained below.

The voltage measuring circuit 110 is configured to receive via the first and second connectors 101, 102 an input of a voltage generated by a thermocouple, and to provide an output that is indicative of the magnitude of the voltage. The voltage measuring circuit 110 may comprise, for example, an op-amp 112 (U2) configured as a differential amplifier that is used to determine the difference of two voltage inputs, multiplied by a constant. The negative (−) and positive (+) voltage outputs from a thermocouple are connected to the first and second connectors 101, 102. The thermocouple's positive (+) voltage V2 is connected to the second connector 102 and applied across a resistor R5 and input to a non-inverting (+) pin of the op-amp 112, and the negative (−) voltage V1 is connected to the first connector 101 and applied across a resistor R4 and input to an inverting (−) pin of the op-amp 112, where the resistance of R4 equals R5. The measuring circuit 110 may include a compensating capacitor C2 in parallel with resistor R3. The amplification or gain is established by resistors R3, R6, where the resistance of R3 equals R6, and the output of the op-amp is given by:

$$V\text{out}=A(V2-V1),$$

where $$A=R3/R4=R6/R5$$

Accordingly, the voltage measuring circuit 110 provides an amplified voltage output 114 that is representative of the differential voltage potential between the first and second connectors 101, 102 coupled to a thermocouple, to thereby provide an output 114 that is indicative of the magnitude of the voltage generated by the thermocouple (typically 0-35 millivolts). The output 114 of the voltage measuring circuit 110 is coupled or communicated to an input 142 of a controller 140, as described below.

As shown in FIG. 1, the apparatus 100 includes a controller 140 that is coupled via input 142 to the voltage measuring circuit 110 so as to receive the output 114 of the voltage measuring circuit 110. The controller 140 may be, for example, a microprocessor (U1) that is configured to establish a switch sequence for switching a light emitting device 130 on and off in a steady flashing manner as the thermocouple voltage increases. Alternatively, the controller 140 may be configured to establish, based on the output 114 indicative of the voltage level of the thermocouple, a switch sequence for switching a light emitting device 130 on and off to generate a flash rate (e.g., discernable blink rate) corresponding to the magnitude of the voltage generated by the thermocouple. Similarly, the controller 140 could, as the thermocouple voltage level increases, utilize a dimming frequency (e.g., 1-40 Hertz, using pulse-width-modulation or varying of RMS voltage) to switch the light emitting device and cause it to rapidly flash so as to vary its output from dim to bright (human eye does not interpret a flicker but rather a continuous light stream). Thus, the controller 140 is configured to controllably switch a light emitting device to provide an indication that the thermocouple voltage is increasing towards a level sufficient to cause a valve operator to hold the pilot valve open (FIG. 3).

Where the controller 140 is a microprocessor (U1), the voltage magnitude or level may be determined by a preprogrammed algorithm, which processes the output 114 indicative of thermocouple voltage level to determine a duration and frequency at which to controllably switch a connection at 144 for switching on and off the light emitting device 130 (such as light emitting diode DS1). Specifically, one or more batteries 146 provide a voltage V+ that is connected via switch SW1 and applied across a light emitting device 130 (and optionally resistor R1) when the controller 140 or microprocessor U1 controllably switches a connection at 144 for turning the light emitting device 130 on and off.

Based on the output 114 of the voltage measuring circuit 110, the controller 140 or microprocessor U1 preferably switches the light emitting device 130 or light emitting diode DS1 on and off at a given duration and frequency to generate a flash rate that increases as the magnitude of the thermocouple voltage increases, to thereby produce an increasing flash rate to provide an indication of when the voltage magnitude is approaching a sufficient level to cause a valve operator to hold the gas valve open, as described below.

Figure 3:
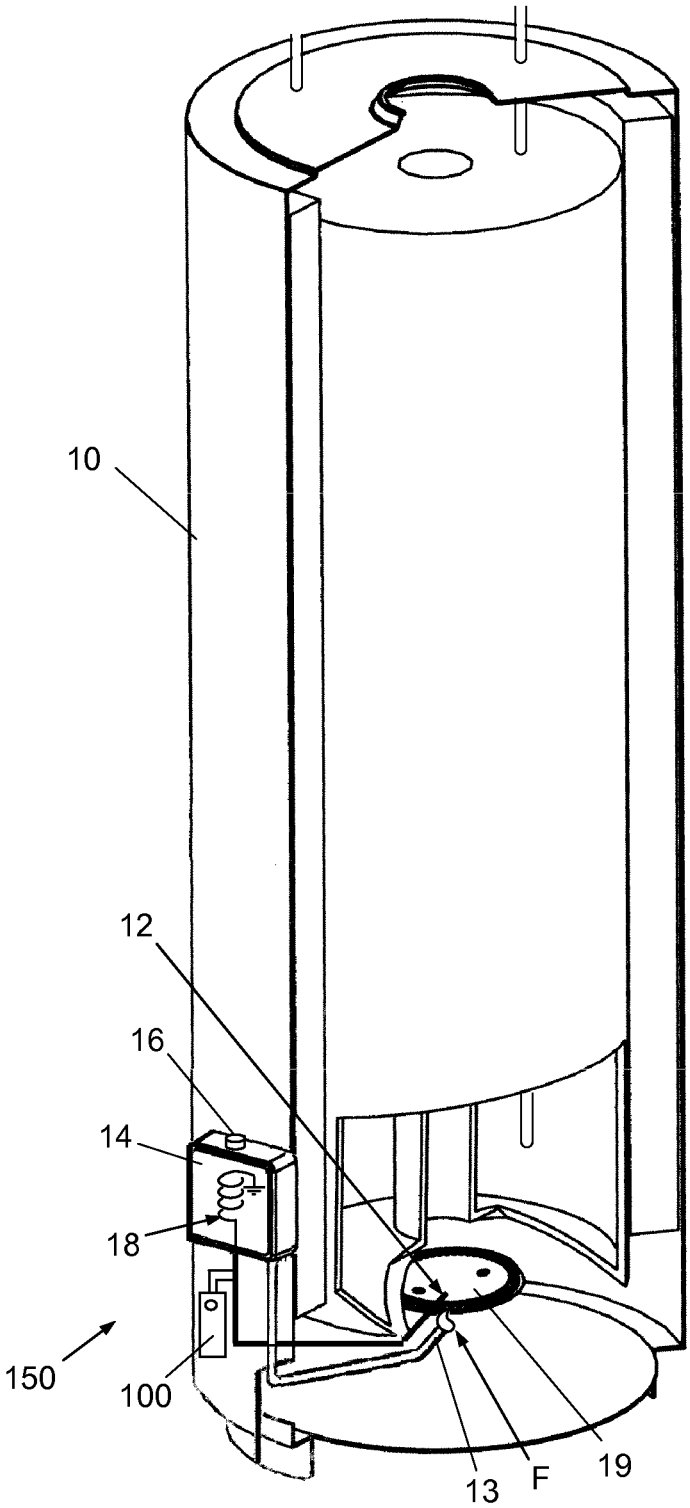
FIG. 3 is an illustration of a gas water heater system including a thermocouple and the apparatus in FIG. 1.

Referring to FIG. 3, a gas water heater appliance 10 with a thermocouple 12 adjacent a standing pilot burner 13 is depicted along with the apparatus 100 shown in FIGS. 1-2. The gas water heater appliance 10 further includes a gas valve 14 having a manually-opened pilot valve 16 that is held in an open position when a sufficient voltage is applied to a valve operator 18 (e.g., a solenoid coil that generates a magnetic field for holding the pilot valve open). In operation, the manually-opened pilot valve 16 is pushed or depressed to open the pilot valve 16 and establish the supply of gas to the standing pilot burner 13. A manually operated ignition device such as a piezo igniter is pushed or activated to establish a pilot flame at the standing pilot burner 13, while the manually-opened pilot valve 16 is held down to maintain gas flow. The thermocouple 12 converts heat from the established gas pilot flame F into a voltage that is applied to the valve operator 18. The manually-opened pilot valve 16 is held down until the magnitude of the voltage generated by the thermocouple 12 is sufficient to cause the valve operator 18 to hold the pilot valve 16 open. Once a sufficient pilot flame and thermocouple voltage is established to drive the valve operator 18, the pilot burner 13 burns gas continuously to provide for ignition of a main burner 19. Thus, the valve operator 18 and pilot valve 16 operate independently of any connection to electrical power within the residential or commercial building. However, it is difficult for users to ascertain how long they must hold down the manually-opened pilot valve 16 before the magnitude of the voltage generated by the thermocouple 12 is sufficient to enable the valve operator 18 to hold the pilot valve 16 open, as explained below.

Figure 4:
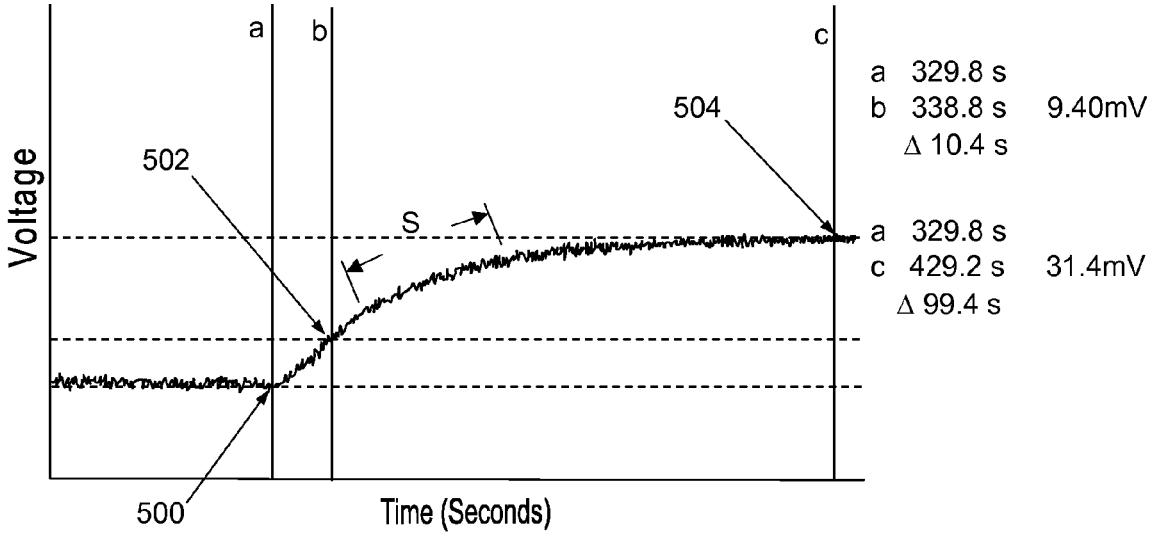
FIG. 4 is a graph illustrating the magnitude of the voltage generated by a thermocouple, as determined from data obtained during ignition.

FIG. 4 is a graph illustrating the magnitude of the voltage generated by a thermocouple 12 from data obtained using a relatively new thermocouple measured during an ignition sequence. Once the ignition device ignites the gas to establish a pilot flame, the heat generated by the pilot flame is converted by the thermocouple 12 into a voltage. As shown at 502, a voltage level of about 9.4 millivolts is established at approximately 10.4 seconds after ignition occurs (at 500). The magnitude of the voltage generated by the thermocouple 12 continues to increase over time, and reaches a peak voltage level of about 31.4 millivolts at approximately 99.4 seconds after ignition occurs. The portion of the curve S indicates the level at which the generated voltage may be sufficient to power the valve operator 18 to hold the pilot valve 16 open. However, the rate of voltage increase and the peak voltage level provided by the thermocouple 12 may degrade over time, such that it is difficult to ascertain the exact time at which the generated voltage has reached a magnitude sufficient to cause the valve operator 18 to hold the pilot valve 16 open (see FIG. 3).

Accordingly, a system 150 is provided for indicating when the level of pilot flame output and thermocouple voltage generated therefrom is sufficient to drive a valve operator to hold a pilot valve open. As shown in FIG. 3, the system 150 includes a gas valve 14 having a manually-opened pilot valve 16 that is held in an open position when a sufficient voltage is applied to a valve operator 18. The system 150 includes a thermocouple 12 that converts heat from a pilot flame F into a voltage that is applied to the valve operator 18. The system 150 includes an apparatus 100 having a light emitting device 130 and a voltage measuring circuit (circuit 110 in FIG. 1) that is configured to provide an output indicative of a magnitude of the voltage generated by the thermocouple 12. The apparatus 100 includes a controller (controller 140 in FIG. 1) that is coupled to the light emitting device 130 and the voltage measuring circuit. The controller is configured to determine from the output of the voltage measuring circuit the magnitude of the voltage generated by the thermocouple 12, and to controllably switch the light emitting device 130 on and off in a flashing manner to generate a flash rate corresponding to the magnitude of the thermocouple voltage. The flash rate increases as the thermocouple voltage increases to provide an indication of when the voltage level is sufficient to cause the valve operator 18 to hold the pilot valve 16 open, where the manually-opened pilot valve 16 must be depressed and held down until the magnitude of the voltage generated by the thermocouple 12 is sufficient to hold the pilot valve 16 open.

While the first embodiment of an apparatus 100 shown in FIG. 1 has a microprocessor as part of the controller 140, other embodiments may have a controller 140 that does not comprise a microprocessor, as explained below.

Figure 5:
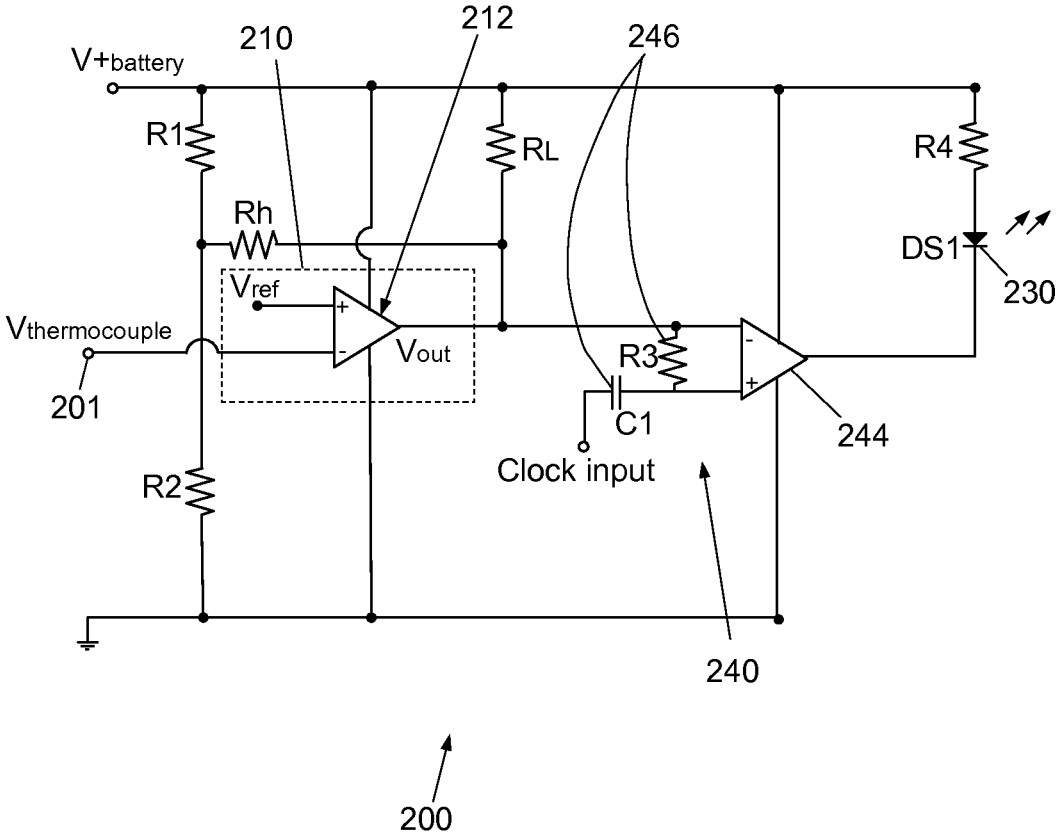
FIG. 5 is a schematic diagram of the apparatus shown in FIG. 1.

Referring to FIG. 5, a schematic diagram is shown of a second embodiment of an apparatus 200. The apparatus 200 includes at least a first connector 201 configured to be coupled to a thermocouple that generates a voltage in response to a gas pilot flame supplied by a gas valve (see FIG. 3). The apparatus 200 includes a voltage measuring circuit 210 that is coupled to the at least the first connector 201, and is configured to provide an output that varies with respect to or commensurate with changes in the magnitude of the voltage generated by the thermocouple. In FIG. 5, the voltage measuring circuit 210 is an op-amp 212 configured as a comparator for comparing the thermocouple voltage to a reference voltage. The apparatus 200 includes a controller 240 that is coupled to the voltage measuring circuit 210 and a light emitting device 230. The controller 240 may comprise a time constant circuit 246 that controllably switches on and off a switching device 244 to switch a battery voltage to the light emitting device 230. Alternatively, the controller 240 may comprise an equivalent circuit for providing a square wave output having a frequency that increases as the thermocouple voltage increases, for use in controllably switching the switching device 244. Based on the output of the voltage measuring circuit 210, the controller 240 controllably switches the switching device 244 to switch the light emitting device 230 on and off at a given duration and frequency to generate a flash rate corresponding to the magnitude of the voltage generated by the thermocouple. The flash rate increases as the magnitude of the thermocouple voltage increases, to provide an indication of when the magnitude is at a level sufficient to cause a valve operator 18 to hold the pilot valve 16 open (FIG. 3).

It should be noted that in both of the above embodiments, the apparatus 100 and 200 each comprise a battery, wherein the controller and light emitting device are operably powered by the battery only. Thus, the controller and light emitting device do not derive any electrical power from the voltage generated by the thermocouple. As such, the voltage from the thermocouple will provide for operation of the valve operator to hold the pilot valve open, even if the battery has a voltage output that is too low to operate the apparatus 100, 200 to provide an indication of the level of the pilot flame output. In this manner, the apparatus 100, 200 is isolated from the thermocouple circuit, and monitors the level of the pilot flame output without any risk of interrupting or affecting the thermocouple voltage required to hold the pilot valve open.

While the second embodiment of an apparatus in FIG. 5 has a non-programmable controller 240 that controllably switches the light emitting device 230 to provide a flash rate corresponding to the magnitude of the voltage generated by the thermocouple, other embodiments of an apparatus may have a controller that includes a programmable microprocessor, as explained below.

Figure 6:
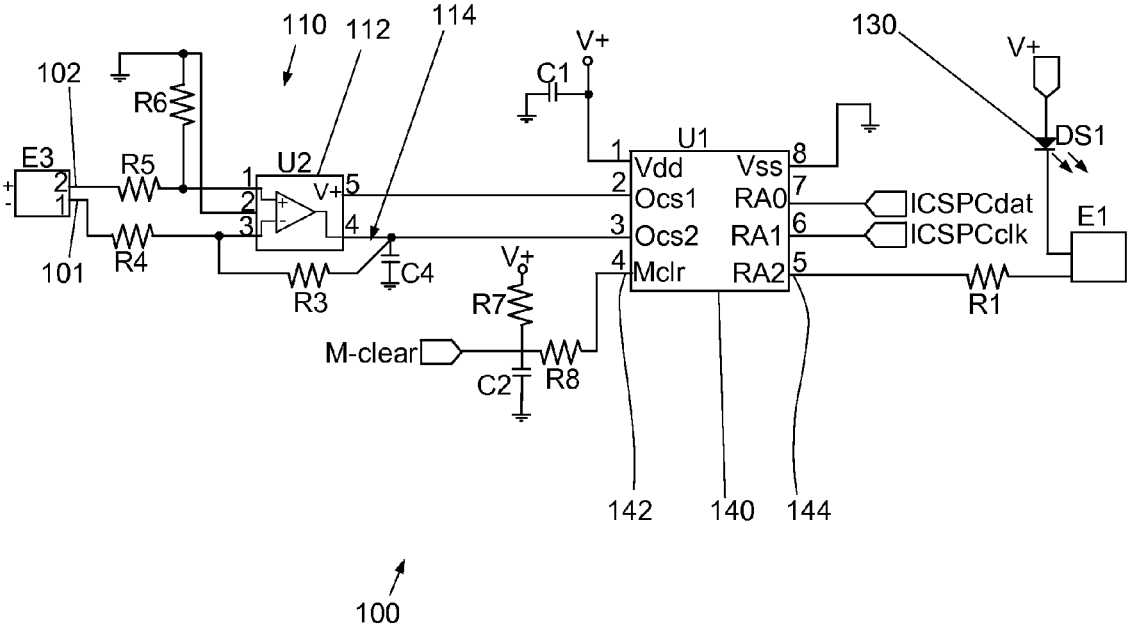
FIG. 6 is a schematic diagram of a second embodiment of an apparatus for indicating the level of a pilot flame output.

Referring to FIG. 6, a schematic diagram is shown of the apparatus 100 shown in FIGS. 1-2. The apparatus includes a voltage measuring circuit 110 configured to receive via first and second connectors 101, 102 an input of the voltage generated by a thermocouple. The voltage measuring circuit 110 includes an op-amp 112 (U2) configured as a differential amplifier that determines a difference in voltage between the first and second connectors 101, 102 coupled to a thermocouple. The negative (−) and positive (+) voltage outputs of the thermocouple are connected to the first and second connectors 101, 102. The positive (+) voltage V2 is connected to the second connector 102 and applied across a resistor R5 and input to the non-inverting (+) pin of the op-amp 112, and the negative (−) voltage V1 is connected to the first connector 101 and applied across a resistor R4 and input to the inverting (−) pin of the op-amp 112. A compensating capacitor C2 is connected in parallel with resistor R3. The voltage measuring circuit 110 provides an output (shown at node 4, op-amp U2) that is indicative of a voltage potential between the first and second connectors 101, 102 (e.g., magnitude of the thermocouple voltage), which is input to a programmable microprocessor (shown at node 3 on U1), as explained below.

As shown in FIG. 6, the apparatus 100 includes a controller 140 comprising a microprocessor (U1) that is configured to determine from the output of the voltage measuring circuit 110 a switch sequence for switching a light emitting device 130 on and off in a flashing manner to generate a flash rate corresponding to the magnitude of the voltage generated by the thermocouple. The microprocessor (U1) may be a PIC12LF-1822 manufactured by Microchip Technology, Inc., and is preferably programmed to include an algorithm that processes the output 114 for determining a duration and frequency at which to controllably switch the light emitting device 130 (e.g., light emitting diode DS1) on and off to generate a flash rate that increases as the magnitude of the thermocouple voltage increases, to thereby provide an indication of when the voltage is at a level sufficient to cause a valve operator 18 to hold the pilot valve 16 open. While microprocessor U1 is programmed to controllably switch the light emitting device 130, the microprocessor U1 may also be programmed to provide monitoring and diagnostic analysis, as explained below.

In addition to providing an indication of when the level of pilot flame output is sufficient (or when the thermocouple's generated voltage is at a magnitude sufficient to hold a pilot valve open), the apparatus of the present disclosure may further be configured to monitor the thermocouple voltage to provide one or more diagnostic functions. For example, the controller 140 shown in FIG. 1 may be further configured to determine when the magnitude of the voltage has reached a peak voltage level and to responsively switch the light emitting device 130 on in a continuous manner for a predetermined time, to provide a continuously visible indication that the voltage generated by the thermocouple has reached a predetermined peak voltage level. In this manner, the apparatus 100 can provide an indication that the thermocouple is functioning properly and that the thermocouple has not degraded to the extent that it can no longer generate the ideal peak voltage level. The above diagnostic feature and others may be provided by an apparatus 100 including a programmable controller 140, as described below.

Figure 7:
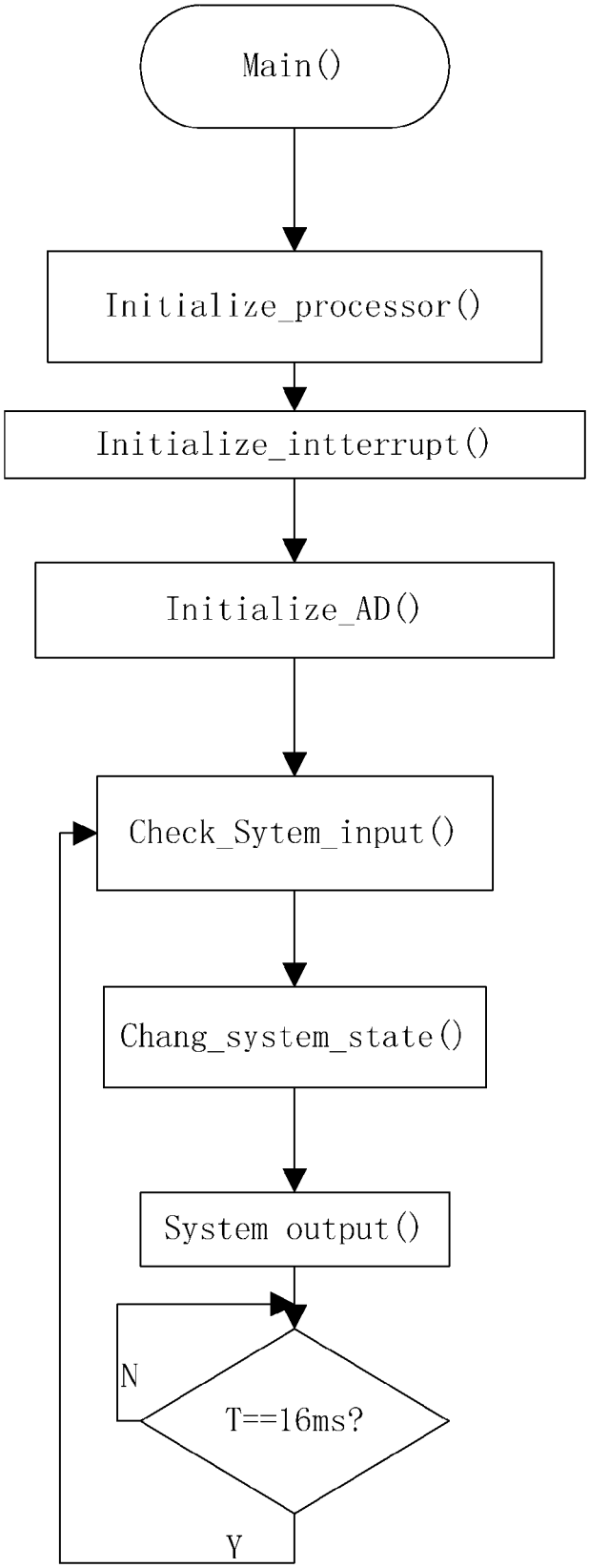
FIG. 7 is a flowchart describing one embodiment of a method of operation of the apparatus.

According to another aspect of the present disclosure, one or more embodiments of a method are provided for controlling operation of the apparatus to monitor one or more conditions. As stated above, the controller 140 in FIG. 1 may be a microprocessor U1 that is programmed via one or more input pins 148 (or inputs ICSPCdat, ICSPCclk in FIG. 6), for input of program data for monitoring a voltage generated by a thermocouple. Referring to FIG. 7, the microprocessor is programmed to repeatedly perform (at given time intervals) the steps of voltage input, system state and system output, which are described in FIGS. 8-10.

Figure 8:
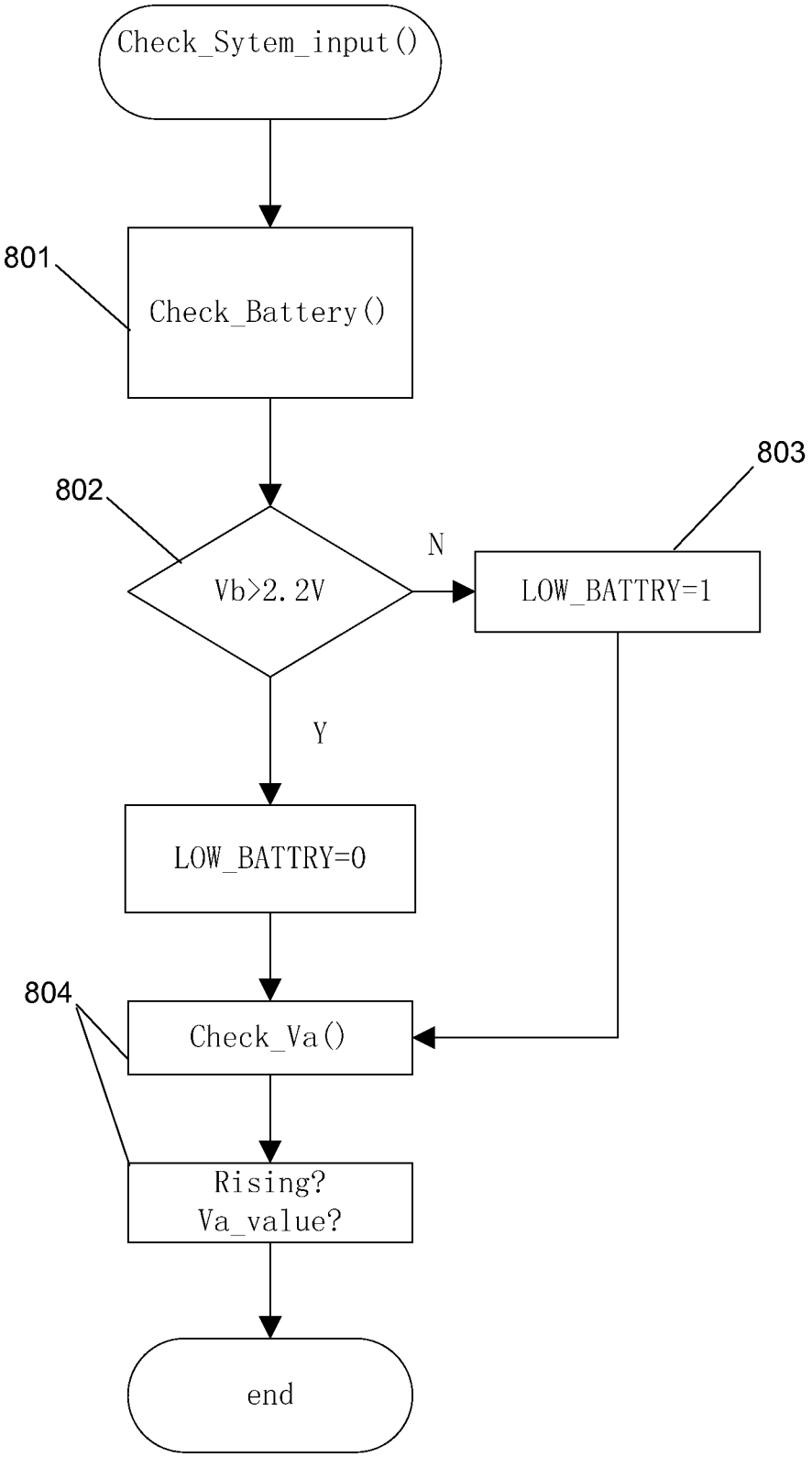
FIG. 8 is a flowchart describing further operation of the apparatus.
Figure 9:
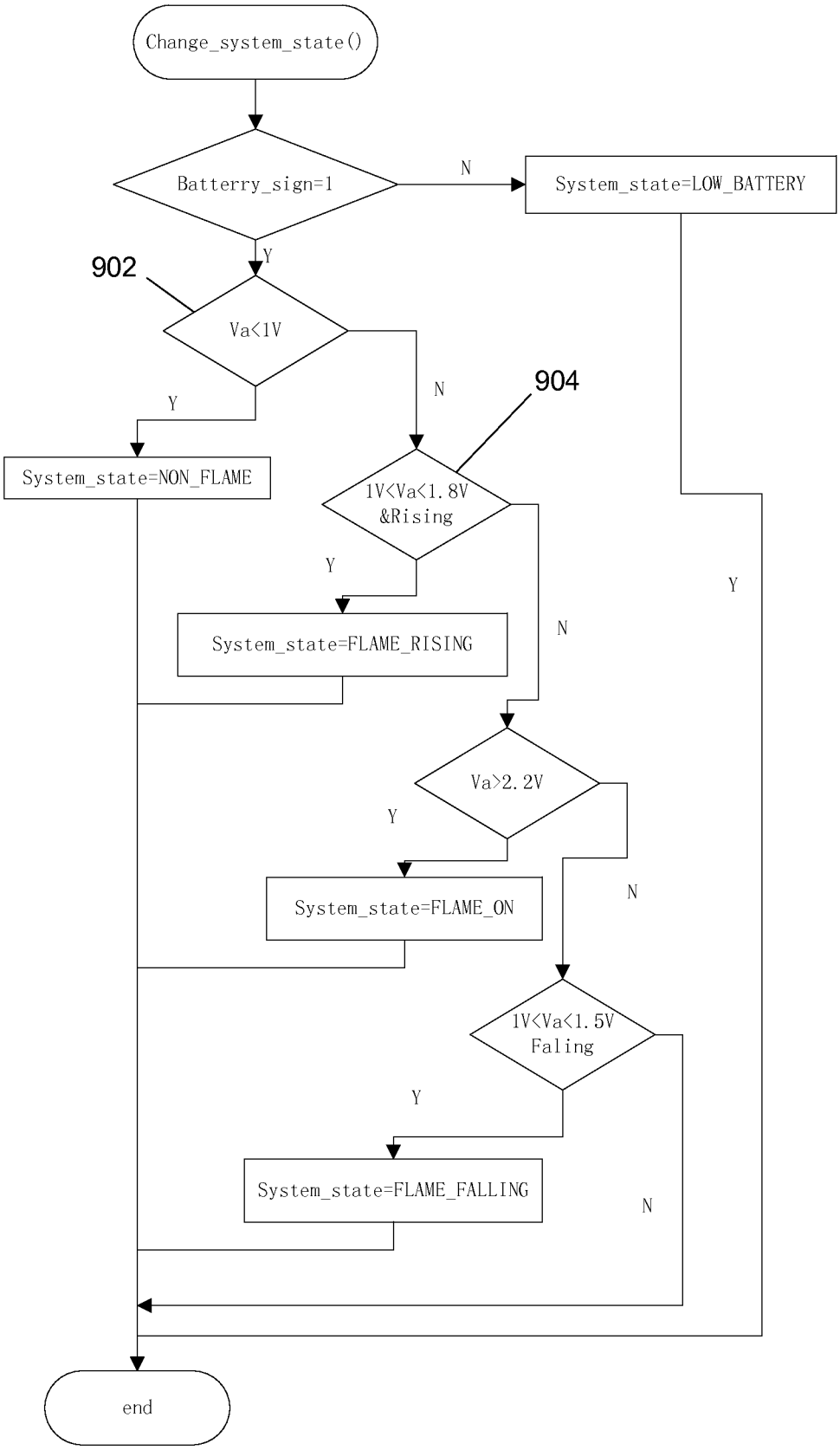
FIG. 9 is a flowchart describing further operation of the apparatus.
Figure 10:
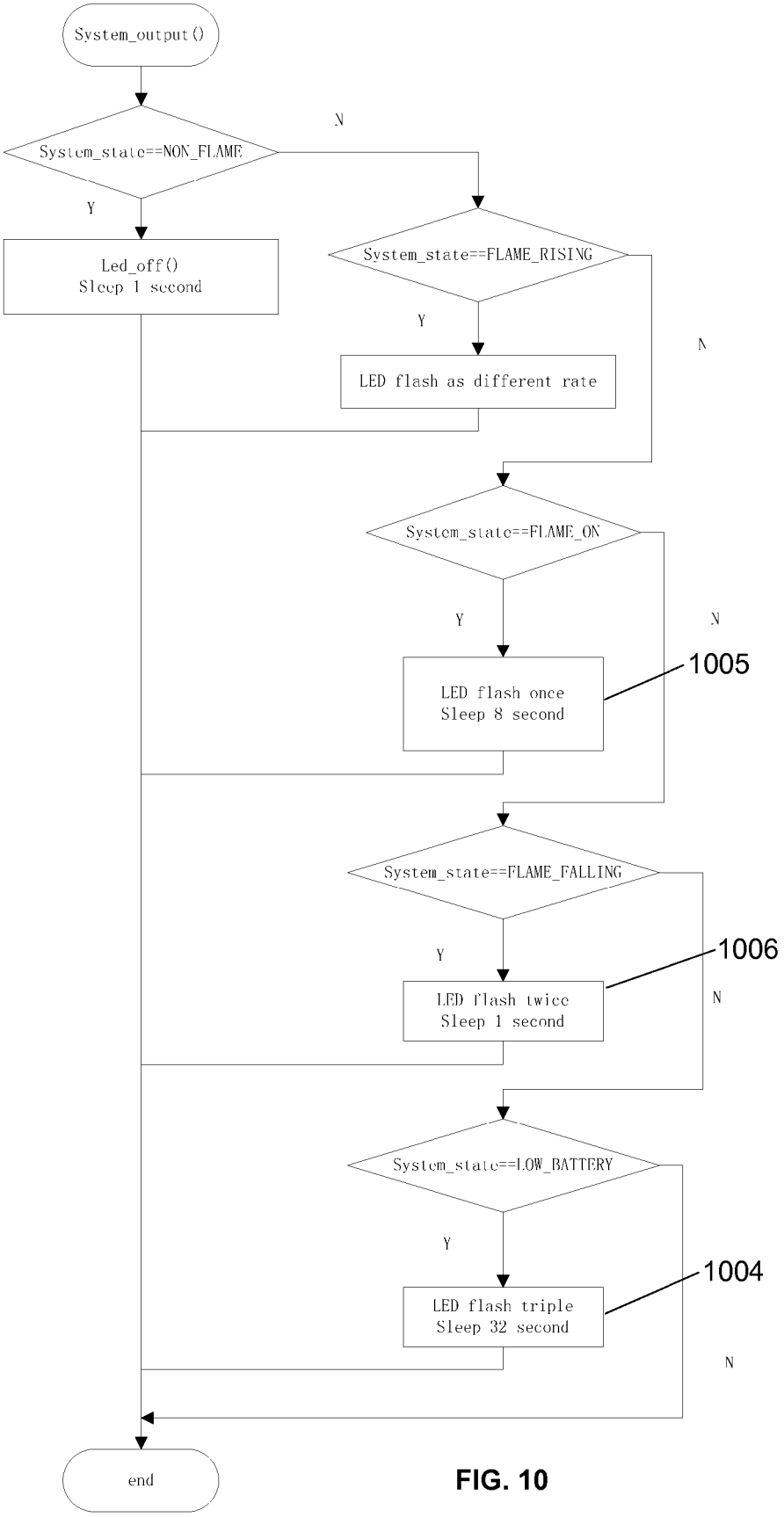
FIG. 10 is a flowchart describing further operation of the apparatus.

Referring to FIGS. 8-10, the controller and/or microprocessor may be programmed to provide a method for controlling operation of the apparatus to monitor the voltage output of the battery. As shown in FIG. 8, the program implementing the method provides for checking the voltage output of the battery at step 801, and determining if the battery voltage level is greater than 2.2 volts at step 802. If less than 2.2 volts, the method sets a low battery state (e.g., low battery condition) at step 803. At step 1004 (in FIG. 10) the method proceeds in controllably switching on the light emitting device (e.g., an LED) at least three or more times in a cyclic manner to establish three repeating flashes for providing an indication that the voltage output of the battery has dropped below an acceptable level.

The controller 140 or microprocessor may also be programmed to provide a method for indicating that the voltage generated by the thermocouple (during pilot flame ignition or thereafter) is at an acceptable peak voltage that is effective to operate a valve operator 18 to hold the pilot valve 16 open (FIG. 3). As shown in FIG. 8, the program implementing the above method proceeds at step 804 to check the output of the voltage measuring circuit 110 indicative of the magnitude of the thermocouple voltage. If, at step 902 in FIG. 9, the level of the thermocouple voltage is found to be less than 1 volt, the method determines that the system is in a Non-Flame condition (e.g., there is no pilot flame and the appliance is off). If at step 902 the method determines that the thermocouple voltage (as amplified by the Op-amp 112) is above 1.8 volts (i.e., not between 1 and 1.8 volts), the method determines that the system is in a Flame-On condition (e.g., a pilot flame is present and the voltage generated by the thermocouple is at an acceptable peak voltage that is effective to operate the valve operator 18). The method and apparatus responsively switch the light emitting device on in a continuous manner for a predetermined time (e.g., 30 seconds), to provide an indication that the voltage generated by the thermocouple has reached a peak voltage level. After the 30 second period, the method and apparatus may provide an indication of peak voltage level in a more efficient, energy saving mode for prolonging battery life, as explained below.

After ignition of the pilot flame has been established, the method proceeds at step 1005 (in FIG. 10) to controllably switch on the light emitting device (e.g., an LED) for a brief period in a cyclic manner to establish a repeating flash for providing an indication that the voltage generated by the thermocouple is at a peak voltage level that is consistent with normal operation of the thermocouple and gas heating appliance.

Furthermore, the controller and/or microprocessor may also be programmed to provide a method for monitoring the thermocouple voltage after establishing a pilot flame to thereafter indicate if the thermocouple voltage has decreased below an acceptable level for reliably operating the valve operator 18. As shown in FIG. 8, the program implementing the above method proceeds at step 804 to check the thermocouple voltage Va (e.g., the output of the voltage measuring circuit 110 indicative of the magnitude of the thermocouple voltage). If, at step 902 in FIG. 9, the voltage level (as amplified by the Op-amp) is found to be less than 1 volt, the method determines that the system is in a Non-Flame condition (e.g., the heating appliance has been shut off). If at step 904 the method determines that the thermocouple voltage (as amplified) is between 1 and 1.8 volts, the method then determines that the system is in a Flame Falling condition (e.g., insufficient pilot flame heat or thermocouple degradation is reducing the voltage generated below an acceptable level for reliably operating the valve operator 18). At step 1006 (in FIG. 10) the method proceeds in controllably switching on the light emitting device at least two or more times in a cyclic manner to establish at least two repeating flashes for providing an indication that the thermocouple voltage has dropped below an acceptable level consistent with a problem with the thermocouple and/or gas heating appliance.

The above methods and apparatus provide for controllably switching on and off a light emitting device for providing various indications as to the operational status of the standing pilot flame and thermocouple output, which various indications are illustrated in the Table below.

TABLE 1

| | thermocouple voltage | Voltage of Va | Led state |
|---|---|---|---|
| rising | 0~5 mv | 0~1 v | Led off |
| | 5 mv~7 mv | 1~1.4 v | Led flash one time per 0.54 s |
| | 7 mv~9 mv | 1.4 v~1.8 v | Led flash one time per 0.27 s |
| | 9 mv~11 mv | 1.8 v~2.2 | Led flash one time per 0.135 s |
| falling | 2.5 mv~7.5 mv | 0.5 v~1.5 | Led flash one time per 0.54 s, after flash two times will go to sleep. When wake up will continue to flash two times. |
| | Above 11 mv | Above 2.2 | Led flash one time per 0.54 s, after flash one time will go to sleep. When wake up will continue to flash one time. |

To further prolong battery life, the above described apparatus and methods may employ a microprocessor having a low power mode for reducing power usage by the microprocessor, by entering into a sleep mode for a predetermined "inactive" time period (e.g., nine seconds) and then returning to operation for a brief time period (e.g., 1 second). In this manner, the apparatus and methods provide an energy conserving "sleep" mode for a predetermined time period, followed by brief operation at given time intervals to determine a voltage input, system state and system output (e.g., provide an indication of voltage level, etc.). Unlike thermal powered circuits that operate from voltage or power derived from a thermocouple or thermo-pile and a large pilot flame required to create the amount of thermal energy required by the circuit, the present apparatus draws no power from the thermocouple and relies on a battery powered circuit that is configured to operate intermittently to prolong battery life up to five years or more.

Accordingly, various embodiments of a method are provided for the above described apparatus. It should be understood that the above described controller and/or apparatus may be configured and/or programmed to determine, from a voltage measuring circuit input, the magnitude of the voltage generated by a thermocouple by utilizing an algorithm within the program, or by alternatively using a look-up table comprising a plurality of values associated with a magnitude of the thermocouple voltage. Likewise, the above described apparatus may alternatively utilize an audible alarm to provide a beep or other sound in place of the indication provided by the light emitting device. Similarly, the above described apparatus may be employed with different forms of gas fired heating appliances and systems.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. An apparatus for indicating the presence of flame in a gas appliance, comprising:

a voltage measuring circuit having first and second connectors configured to be coupled to a thermocouple that generates a voltage from a gas pilot flame that receives gas from a gas valve, the voltage measuring circuit being configured to provide an output indicative of a magnitude of the voltage generated by the thermocouple;

a light emitting device;

a controller coupled to the voltage measuring circuit and the light emitting device, the controller being configured to controllably switch the light emitting device on and off in a flashing manner at a frequency based on the output indicative of the magnitude of the voltage generated by the thermocouple, to thereby generate a flash rate corresponding to the magnitude of the voltage generated by the thermocouple;

wherein the flash rate increases as the magnitude of the voltage increases, to thereby provide an indication of when the voltage magnitude is sufficient to cause a valve operator to hold the gas valve open; and a battery;

wherein the controller and light emitting device are operably powered by the battery only;

the apparatus being operable in connection with the thermocouple without the apparatus controlling operation of a circuit in which the thermocouple generates the voltage for operation of the valve operator such that the voltage from the thermocouple will provide for operation of the valve operator to hold the pilot valve open even if the battery has a voltage output that is too low to operate the apparatus.

2. The apparatus of claim 1, wherein the controller and light emitting device do not derive any electrical power from the voltage generated by the thermocouple.

3. The apparatus of claim 1, where the controller comprises a voltage comparator that compares the voltage generated by the thermocouple to a reference voltage and responsively provides an output that is indicative of the magnitude of the voltage generated by the thermocouple.

4. The apparatus of claim 1, wherein the controller includes a circuit configured to provide a square wave output having a frequency that increases as the magnitude of the generated voltage increases, which square wave output is utilized in controllably switching the light emitting device on and off in a flashing manner to generate a flash rate corresponding to the magnitude of the voltage generated by the thermocouple.

5. The apparatus of claim 1, wherein the controller comprises a microprocessor that is configured to establish, based on the output indicative of the magnitude of the voltage generated by the thermocouple, a switch sequence for switching the light emitting device on and off in a flashing manner to generate a flash rate corresponding to the magnitude of the voltage generated by the thermocouple.

6. The apparatus of claim 1, wherein the controller is further configured to determine when the magnitude of the voltage has reached a peak voltage level and to responsively switch the light emitting device on in a continuous manner for a predetermined time to provide an indication that the voltage generated by the thermocouple has reached the peak voltage level.

7. The apparatus of claim 1, wherein the controller is further configured to monitor the voltage measuring circuit after the voltage has reached a sufficient magnitude, and is configured to controllably switch the light emitting device on at least once for a given time duration to provide an indication that the voltage generated by the thermocouple is at a peak voltage level.

8. The apparatus of claim 1, wherein the controller is further configured to monitor the voltage measuring circuit after the voltage has reached a sufficient magnitude, and is configured to switch the light emitting device on and off at least two or more times in a cyclic manner to establish a plurality of flashes to provide an indication that the voltage generated by the thermocouple has dropped below an acceptable level.

9. The apparatus of claim 1, wherein the controller is further configured to monitor the voltage output of the battery, and is configured to switch the light emitting device on and off at least three or more times in a cyclic manner to establish a plurality of flashes to provide an indication that the voltage output of the battery has dropped below an acceptable level.

10. The apparatus of claim 1, wherein the controller is configured to controllably switch the light emitting device on and off at least 10 times per second to provide an indication that the magnitude of the voltage generated by the thermocouple is sufficient to cause a valve operator to hold the gas valve open.

11. A system for indicating the presence of flame in a gas appliance having a manually opened gas valve, comprising:

a gas valve having a manually-opened pilot valve that is held in an open position when a sufficient voltage is applied to a valve operator;

a thermocouple that converts heat from a gas pilot flame into a voltage that is applied to the valve operator;

a voltage measuring circuit coupled to the thermocouple, the voltage measuring circuit being configured to provide an output indicative of a magnitude of the voltage generated by the thermocouple;

a light emitting device;

a controller coupled to the voltage measuring circuit and the light emitting device, the controller comprising a microprocessor that is configured to monitor the output indicative of the magnitude of the voltage generated by the thermocouple, and to controllably switch the light emitting device on and off in a flashing manner to provide an indication of when the voltage generated by the thermocouple is increasing towards a level sufficient to cause the valve operator to hold the pilot valve open; and at least one battery;

wherein the controller and light emitting device are operably powered by the at least one battery only;

wherein the valve operator and gas valve are operable independently of the voltage measuring circuit and controller such that the voltage measuring circuit and the controller monitor the level of the pilot flame output without any risk of interrupting or affecting the thermocouple voltage required to hold the pilot valve open.

12. The apparatus of claim 11, wherein the controller and light emitting device do not derive any electrical power from the voltage generated by the thermocouple.

13. The apparatus of claim 11, where the voltage measuring circuit comprises an op-amp configured as a differential amplifier that is used to determine the difference in voltage potential between first and second connections to the thermocouple, and to provide an output that is commensurate with the magnitude of the voltage generated by the thermocouple.

14. The apparatus of claim 11, wherein the controller is configured to establish, based on the output indicative of the magnitude of the voltage generated by the thermocouple, a switch sequence for switching the light emitting device on and off in a flashing manner to establish a flash rate that increases as the magnitude of the voltage generated by the thermocouple increases, to thereby provide an indication of when the voltage generated by the thermocouple magnitude is sufficient to cause a valve operator to hold the pilot valve open.

15. The apparatus of claim 11, wherein the controller is configured to controllably switch the light emitting device on and off at a frequency greater than 1 kilohertz to cause the light emitting device to rapidly flash and vary its output from dim to bright as the magnitude of the voltage generated by the thermocouple increases towards a level sufficient to cause the valve operator to hold the pilot valve open.

16. The apparatus of claim 11, wherein the controller is further configured to determine when the magnitude of the voltage has reached a peak voltage level and to responsively switch the light emitting device on in a continuous manner for a predetermined time to provide an indication that the voltage generated by the thermocouple has reached the peak voltage level.

17. The apparatus of claim 11, wherein the controller is further configured to monitor the voltage measuring circuit after the voltage has reached a sufficient magnitude, and is configured to controllably switch the light emitting device on at least once for a given time duration to provide an indication that the voltage generated by the thermocouple is at a peak voltage level.

18. The apparatus of claim 11, wherein the controller is further configured to monitor the voltage measuring circuit after the voltage has reached a sufficient magnitude, and is configured to switch the light emitting device on and off at least two or more times in a cyclic manner to establish a plurality of flashes to provide an indication that the voltage generated by the thermocouple has dropped below an acceptable level.

19. The apparatus of claim 11, wherein the controller is further configured to monitor the voltage output of the at least one battery, and is configured to switch the light emitting device on and off at least three or more times in a cyclic manner to establish a plurality of flashes to provide an indication that the voltage output of the at least one battery has dropped below an acceptable level.

20. The apparatus of claim 11, wherein the controller is configured to controllably switch the light emitting device on and off at least 10 times per second to provide an indication that the magnitude of the voltage generated by the thermocouple is sufficient to cause a valve operator to hold the gas valve open.

21. A system for indicating the presence of flame in a gas appliance having a manually opened gas valve, comprising:

a gas valve having a manually-opened pilot valve that is held in an open position when a sufficient voltage is applied to a valve operator;

a thermocouple that converts heat from a gas pilot flame into a voltage that is applied to the valve operator;

a voltage measuring circuit coupled to the thermocouple, the voltage measuring circuit being configured to provide an output indicative of a magnitude of the voltage generated by the thermocouple;

at least one battery;

a light emitting device; and a controller coupled to the voltage measuring circuit and the light emitting device, the controller comprising a microprocessor that is configured to monitor the output indicative of the magnitude of the voltage generated by the thermocouple, and to controllably switch the light emitting device on and off in a flashing manner to provide an indication of when the voltage generated by the thermocouple is increasing towards a level sufficient to cause the valve operator to hold the pilot valve open;

wherein the controller and the light emitting device are operably powered by the battery only;

wherein the valve operator and gas valve are operable independently of the voltage measuring circuit and controller;

wherein the controller comprises a microprocessor that includes a low power sleep mode in which the microprocessor is inactive for a predetermined time period, after which the microprocessor is returned to operation at a given time interval, to thereby reduce power usage by the microprocessor and extend the useful life of the at least one battery.

* * * * *